US011019416B2

(12) United States Patent
Spillmann et al.

(10) Patent No.: US 11,019,416 B2
(45) Date of Patent: May 25, 2021

(54) SUSPENSION SYSTEM MECHANISM

(71) Applicant: Harman International Industries, Incorporated, Stamford, CT (US)

(72) Inventors: Jacques Spillmann, Los Angeles, CA (US); Lawrence Romestant, Northridge, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/387,018

(22) Filed: Apr. 17, 2019

(65) Prior Publication Data

US 2019/0246189 A1 Aug. 8, 2019

Related U.S. Application Data

(63) Continuation of application No. 15/966,856, filed on Apr. 30, 2018, now Pat. No. 10,284,938, which is a (Continued)

(51) Int. Cl.
*H04R 1/02* (2006.01)
*H04R 1/32* (2006.01)

(Continued)

(52) U.S. Cl.
CPC ..... *H04R 1/026* (2013.01); *H04R 1/323* (2013.01); *H04R 1/403* (2013.01); *H04R 27/00* (2013.01);

(Continued)

(58) Field of Classification Search
CPC ..... H04R 1/026; H04R 1/028; H04R 1/323; H04R 1/403; H04R 2201/025; H04R 2201/401; H04R 2201/403; H04R 2499/13

(Continued)

(56) References Cited

U.S. PATENT DOCUMENTS 5,749,137 A 5/1998 Martin
5,819,959 A 10/1998 Martin (Continued)

FOREIGN PATENT DOCUMENTS

EP 2787745 A1 10/2014

OTHER PUBLICATIONS

Spek-Trix User Manual version 1.0, Adamson Systems Engineering, Copyright, 2009.

(Continued)

*Primary Examiner* — Huyen D Le
(74) *Attorney, Agent, or Firm* — Brooks Kushman P.C.

(57) ABSTRACT

A method for installation of a line array of speaker assemblies is provided. At least two stacked speaker assemblies with suspension systems are provided. An installation splay angle between the at least two stacked speaker assemblies is selected, while the two stacked speaker assemblies are oriented at an initial splay angle. The suspension system of an uppermost speaker assembly of the at least two stacked speaker assemblies is connected to a support. The support is raised to lift the at least two stacked speaker assemblies, whereby the at least two stacked speaker assemblies pivot from the initial splay angle to the installation splay angle and form a line array.

17 Claims, 14 Drawing Sheets

Related U.S. Application Data continuation of application No. 15/419,412, filed on Jan. 30, 2017, now Pat. No. 9,992,565.

(60) Provisional application No. 62/357,851, filed on Jul. 1, 2016.

(51) Int. Cl.
*H04R 1/40* (2006.01)
*H04R 27/00* (2006.01)

(52) U.S. Cl.
CPC .. *H04R 2201/025* (2013.01); *H04R 2201/401* (2013.01); *H04R 2201/403* (2013.01)

(58) Field of Classification Search
USPC ..... 381/304, 87, 334, 335, 336, 182, 186, 381/387; 181/144, 145, 150, 199
See application file for complete search history.

(56) References Cited

U.S. PATENT DOCUMENTS

| | | | | |
|---|---|---|---|---|
| 5,996,728 | A * | 12/1999 | Stark | H04R 1/028 181/144 |
| 6,536,842 | B2 | 3/2003 | Bowers et al. | |
| 6,640,924 | B2 | 11/2003 | Messner | |
| 7,206,427 | B2 * | 4/2007 | Simidian, II | H04R 1/026 381/335 |
| 7,261,180 | B1 | 8/2007 | Faranda | |
| 7,298,860 | B2 | 11/2007 | Engebretson et al. | |
| 7,328,769 | B1 | 2/2008 | Adamson | |
| 7,634,100 | B2 | 12/2009 | Monitto | |
| 7,693,296 | B2 | 4/2010 | Monitto | |
| 8,170,263 | B2 | 5/2012 | Engebretson et al. | |
| 9,124,969 | B2 | 9/2015 | McGhee | |
| 9,992,565 | B2 | 6/2018 | Spillmann | |
| 2002/0153195 | A1 | 10/2002 | Messner | |
| 2003/0231782 | A1 | 12/2003 | Engebretson et al. | |
| 2004/0213425 | A1 | 10/2004 | Simidian | |
| 2005/0232455 | A1 | 10/2005 | Monitto et al. | |
| 2006/0210095 | A1 | 9/2006 | Monitto et al. | |
| 2009/0022354 | A1 | 1/2009 | Parker et al. | |
| 2011/0305362 | A1 | 12/2011 | McGhee et al. | |
| 2012/0189420 | A1 | 7/2012 | Kemper | |
| 2013/0208936 | A1 | 8/2013 | McGhee et al. | |
| 2014/0205126 | A1 | 7/2014 | Faranda et al. | |
| 2014/0205132 | A1 | 7/2014 | Spillmann et al. | |
| 2014/0307907 | A1 | 10/2014 | Takeuchi et al. | |
| 2015/0208150 | A1 | 7/2015 | Spillmann et al. | |

OTHER PUBLICATIONS

Nexo S.A.—GEO T Series User Manual V1.05, May 10, 2010.
L. Acqustics, "K1 Reference WST(R ) System, Rigging Procedures Version 3.0," Apr. 4, 2016, Doc. Ref. No. K1_RM_EN_3.0, www.L--Acquistics.com. (68 pp).

* cited by examiner

SUSPENSION SYSTEM MECHANISM

CROSS-REFERENCE TO RELATED APPLICATIONS

This application is a continuation of U.S. application Ser. No. 15/966,856 filed Apr. 30, 2018, now U.S. Pat. No. 10,284,938, which, in turn, is a continuation of U.S. application Ser. No. 15/419,412 filed Jan. 30, 2017, now U.S. Pat. No. 9,992,565 which, in turn, claims the benefit of U.S. provisional application Ser. No. 62/357,851 filed Jul. 1, 2016, the disclosures of which are hereby incorporated in their entirety by reference herein.

TECHNICAL FIELD

One or more embodiments relate to a suspension system locking mechanism for a line array of speakers.

BACKGROUND

Existing systems are known for adjusting the splay angle of a line array of speakers after they are suspended in the air with hanging equipment using a "pull-back" accessory. For such systems the array is typically suspended with the speakers oriented straight (i.e., zero degree splay angle) and then the pull-back accessory is adjusted to increase tension to adjust the splay angles and bring the rear of the speakers together to form the desired array curvature.

Additional systems for adjusting the splay angle between speakers in a line array are disclosed in U.S. Patent Application Publication Nos. 2014/0205132 and 2015/0208150, both to Spillmann et al.

SUMMARY

In one embodiment, a speaker suspension system is provided with a frame and a lever arm. The lever arm is pivotally connected to an intermediate portion of the frame about a pivot axis with a sector formed at a distal end including a plurality of teeth. The suspension system is also provided with a lock lever and a release lever. The lock lever is pivotally connected to an end portion of the frame with a plurality of pins to engage the plurality of teeth. The lock lever is spring biased away from the sector to a release position. The release lever is pivotally connected to the end portion of the frame and adjacent to the sector. The release lever is spring biased toward the lock lever to maintain engagement of the pins and teeth in a lock position.

In another embodiment a speaker assembly is provided with a cabinet with laterally spaced apart side surfaces and a frame that is mounted to one of the side surfaces with a plurality of apertures formed through. The speaker assembly is also provided with a lever arm and a removeable pin. The lever arm includes a proximal end and a distal end to connect to an upper support. The lever arm also includes an intermediate portion that is pivotally connected to the frame with a plurality of arcuate slots formed through that each align with at least one of the plurality of apertures. Each arcuate slot is formed with an end stop that corresponds to a splay angle of the cabinet relative to the upper support. The removeable pin is attached to the frame and sized to extend through one of the plurality of apertures and the corresponding arcuate slot for a selected splay angle. Whereby suspending the speaker assembly from the upper support pivots the lever arm in a first direction until the removable pin engages the end stop to adjust the splay angle to the selected splay angle.

In yet another embodiment a suspension system is provided with a frame to mount to a side surface of a speaker cabinet with a plurality of apertures formed therethrough. The suspension system is also provided with a lever arm with a proximal end and a distal end that are both adapted to connect to an upper support. The lever arm also has an intermediate portion that is pivotally connected to the frame about a pivot axis with a plurality of arcuate slots formed through. Each arcuate slot is formed with an end stop that corresponds to a splay angle of the speaker cabinet relative to the upper support, and each slot aligns with one of the apertures to receive a pin. Whereby suspending the speaker cabinet from the upper support pivots the lever arm in a first direction until the pin engages the end stop.

In still yet another embodiment, a method for installation of a line array of speaker assemblies is provided. At least two stacked speaker assemblies with suspension systems are provided. An installation splay angle between the at least two stacked speaker assemblies is selected, while the two stacked speaker assemblies are oriented at an initial splay angle. The suspension system of an uppermost speaker assembly of the at least two stacked speaker assemblies is connected to a support. The support is raised to lift the at least two stacked speaker assemblies, whereby the at least two stacked speaker assemblies pivot from the initial splay angle to the installation splay angle and form a line array.

In one embodiment, a speaker assembly is provided with a cabinet with laterally spaced apart side surfaces and a frame mounted to one of the side surfaces. The speaker assembly is also provided with a lever arm and a ratchet mechanism. The lever arm has a proximal end to connect to an upper support, a distal end with a plurality of teeth extending radially outward, and an intermediate portion pivotally connected to the frame for adjusting a splay angle of the cabinet relative to the upper support. The ratchet mechanism is coupled to the frame with at least two pawls each individually biased to engage at least one of the plurality of teeth to allow pivotal motion of the lever arm relative to the frame in a first direction and limit pivotal motion of the lever arm in a second direction that is opposite the first direction.

In another embodiment a suspension system is provided with a frame to mount to a side surface of a speaker cabinet and a lever arm. The lever arm includes a proximal end and a distal end adapted to connect to an upper support, and an intermediate portion pivotally connected to the frame about a pivot axis for adjusting a splay angle of the frame relative to the upper support, and a plurality of teeth extending radially outward from the distal end of the lever arm. The suspension system also includes a latch assembly and a biasing member. The latch assembly is connected to the frame with at least two pins that are adapted to engage the teeth to allow pivotal motion of the lever arm relative to the frame in a first direction and limit pivotal motion of the lever arm in a second direction that is opposite a first direction. The biasing member is coupled to each pin to independently bias each pin towards the plurality of teeth to limit backlash.

In still yet another embodiment, a method for installation of a line array of speaker assemblies is provided. A first line array with at least two stacked speaker assemblies and suspension systems is provided. The two stacked speaker assemblies are oriented at an initial splay angle. An installation splay angle between the at least two stacked speaker assemblies is selected, while the two stacked speaker assemblies are oriented at the initial splay angle. The suspension system of an uppermost speaker assembly of the at least two stacked speaker assemblies is connected to a support. The support is raised to lift the at least two stacked speaker assemblies, whereby a lower speaker assembly pivots from the uppermost speaker assembly to adjust from the initial splay angle to the installation splay angle.

In another embodiment, a method for assembling a line array of speaker assemblies is provided. A first speaker assembly is stacked upon a second speaker assembly. A first suspension system of the first speaker assembly is connected to a second suspension system of the second speaker assembly at a first splay angle between the first speaker assembly and the second speaker assembly. A second splay angle between the first speaker assembly and the second speaker assembly is selected. The first suspension system is connected to a support. The support is raised to lift the speaker assemblies off of an underlying surface thereby adjusting the speaker assemblies from the first splay angle to the second splay angle to form a line array.

As such, the suspension system locking mechanism provides simple and intuitive connections between speaker assemblies by connecting them together independently from selecting their splay angles. Choosing a splay angle can be done prior to occupying the space at the venue, which is often accessible for only a limited time. As a result, a sound crew can setup the line array faster once it is on location at the venue.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
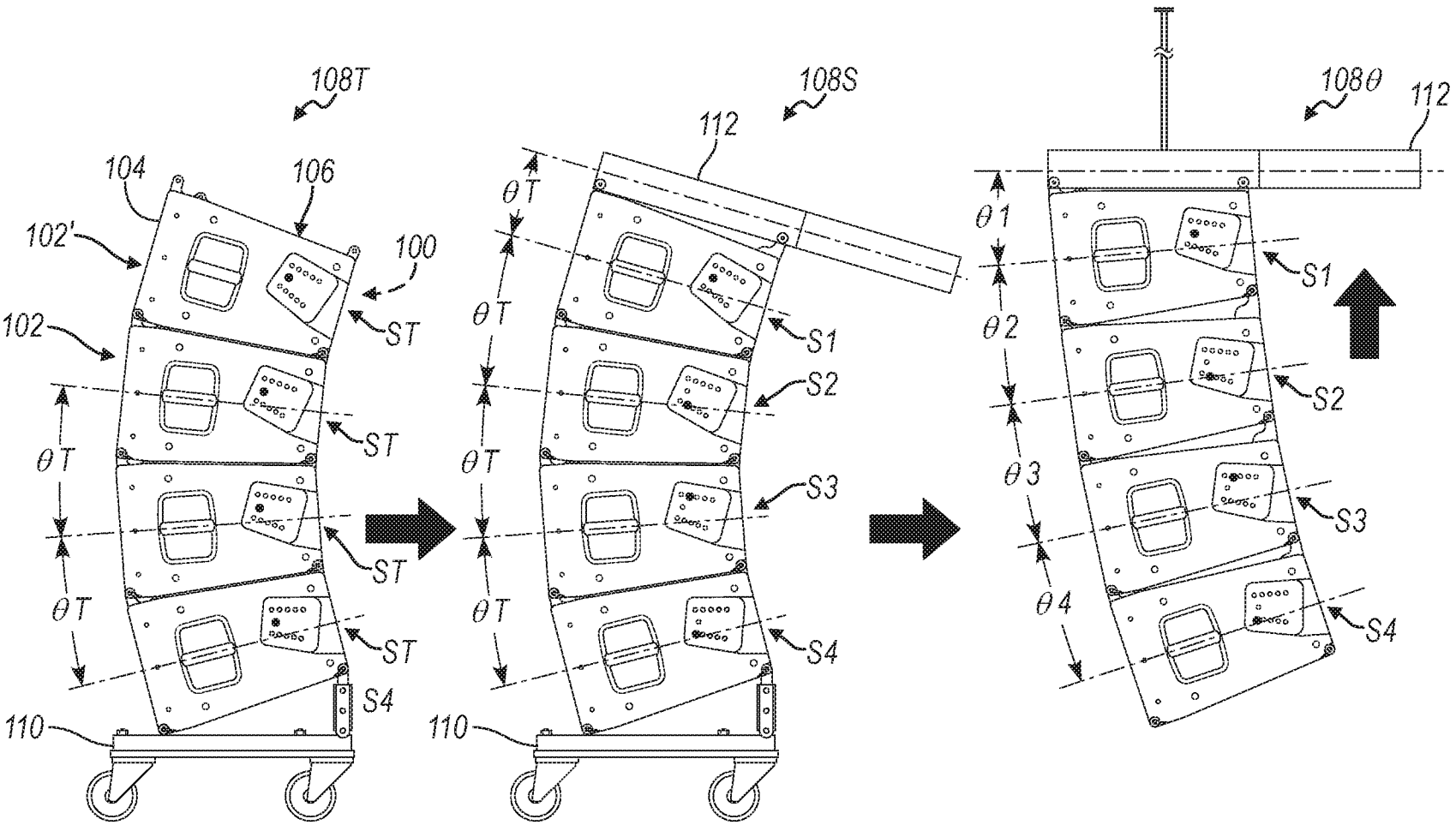
FIG. 1 is a schematic view of speaker assemblies arranged in a line array according to one or more embodiments, illustrated oriented in a transport position, a splay angle selection position and a splay angle adjustment position.

With reference to FIG. 1, a locking mechanism for a suspension system is illustrated in accordance with one or more embodiments and generally represented by numeral 100. A speaker assembly 102 includes a speaker cabinet 104 and a suspension system 106. Each suspension system 106, includes a pair of locking mechanisms 100 that are mounted to opposing lateral sides of the speaker cabinet 104 (shown in FIG. 2). The suspension systems 106 are used to connect vertically adjacent speaker assemblies 102 to form a line array 108. The line arrays 108 may be supported by a cart 110 for transport to a venue, e.g., a stage. The cart 110 functions as a base and rests upon an underlying surface (e.g., a stage) for supporting a line array 108 of speaker assemblies 102. In a tension configuration, the line array 108 is connected to a support, such as an array frame 112 and suspended from an upper structure (not shown).

FIG. 1 illustrates the line array 108 of speaker assemblies 102 in different splay angle orientations: a transport orientation "108T", a splay angle selection orientation "108S" and a splay angle adjustment orientation "108θ". Each speaker assembly 102 is adjusted to a splay angle (e.g., θT, θ1 and θ2) and includes a splay angle selection (e.g., ST, S1 and S2) that may differ from each other during the assembly/disassembly process.

Each speaker assembly 102 is set to a transport splay angle selection (ST) and the suspension system 106 is adjusted to a corresponding transport splay angle (θT) during storage and transport to/from a venue. The locking mechanism 100 allows a user to select the splay angle (S1, S2, S3 and S4) between each speaker assembly 102 and an upper vertically adjacent speaker assembly 102' while the speaker assemblies 102 are still adjusted to the transport splay angle (θT), as depicted by line array 108S. Then as each speaker assembly 102 is suspended, its suspension system 106 adjusts to the selected splay angle (S1, S2, S3 and S4) and the locking mechanism 100 locks the splay angle (θ1, θ2, θ3 and θ4), as depicted by line array 1080. In the illustrated embodiment, ST, S1, θT and θ1 correspond to a splay angle of 10°; S2 and θ2 correspond to a splay angle of 3°; S3 and θ3 correspond to a splay angle of 4°; and S4 and θ4 correspond to a splay angle of 6°.

The locking mechanism 100 provides simple and intuitive connections between speaker assemblies 102 by connecting them together independently from selecting their splay angle (s), thus clearly separating both procedures. Choosing a splay angle can be done prior to occupying the space at the venue (e.g., during transport in line array 108T) which is often accessible for only a limited time. As a result, a sound crew can setup (e.g., suspend or "fly") the line array 108 faster once it is on location.

Figure 2:
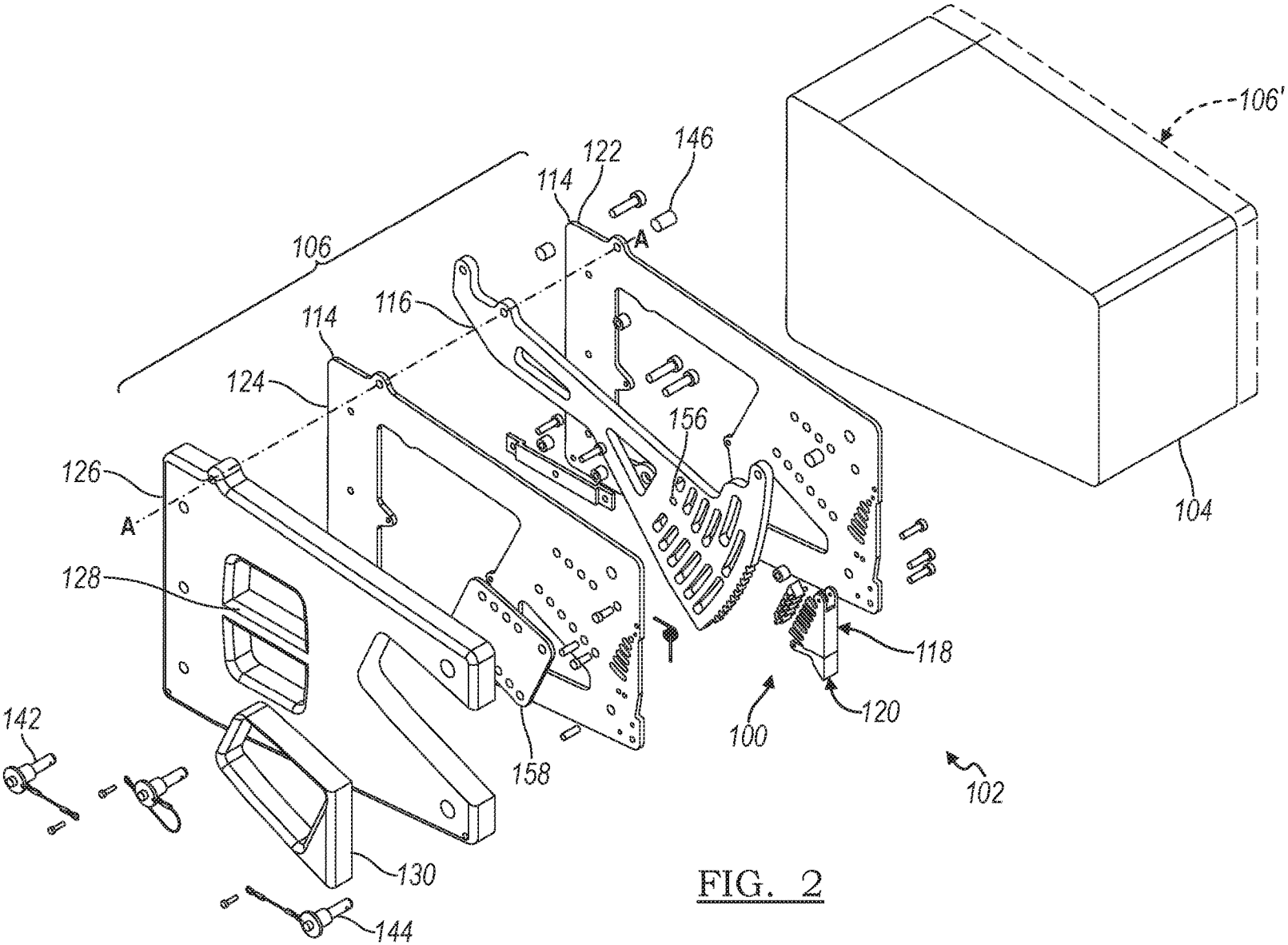
FIG. 2 is a partial exploded view of a speaker assembly of FIG. 1, illustrating a suspension system according to one embodiment.

With reference to FIG. 2, each speaker assembly 102 includes a pair of suspension systems 106, 106' that are mirror images of each other and mounted to opposing lateral sides of the speaker cabinet 104. Each suspension system 106 includes a frame 114 that supports the locking mechanism 100. The locking mechanism 100 includes a lever arm 116, a latch assembly 118 and a release lever 120.

The frame 114 includes a pair of plates 122, 124 that support the locking mechanism 100. The frame 114 includes an inner plate 122 that mounts to the side of the speaker cabinet 104. The frame 114 also includes an outer plate 124 that is laterally spaced apart from the inner plate 122 by a plurality of spacers. The lever arm 116, the latch assembly 118 and the release lever 120 are pivotally connected to each plate 122, 124, and mounted between them.

The suspension system 106 includes a cover 126 that protects and conceals the frame 114 and locking mechanism 100. The cover 126 is connected to an external side of the outer plate 124. The cover 126 extends over openings formed in the frame 114 to help conceal the locking mechanism 100 and to limit debris from entering the frame 114. The cover 126 includes a handle 128 that extends longitudinally along a central portion of the cover 126; which may be used for lifting the speaker assembly 102. In the illustrate embodiment, the suspension system 106 includes a two-piece cover including the main cover 126 and a small cover 130 that is disposed laterally adjacent to the locking mechanism 100.

Figure 3:
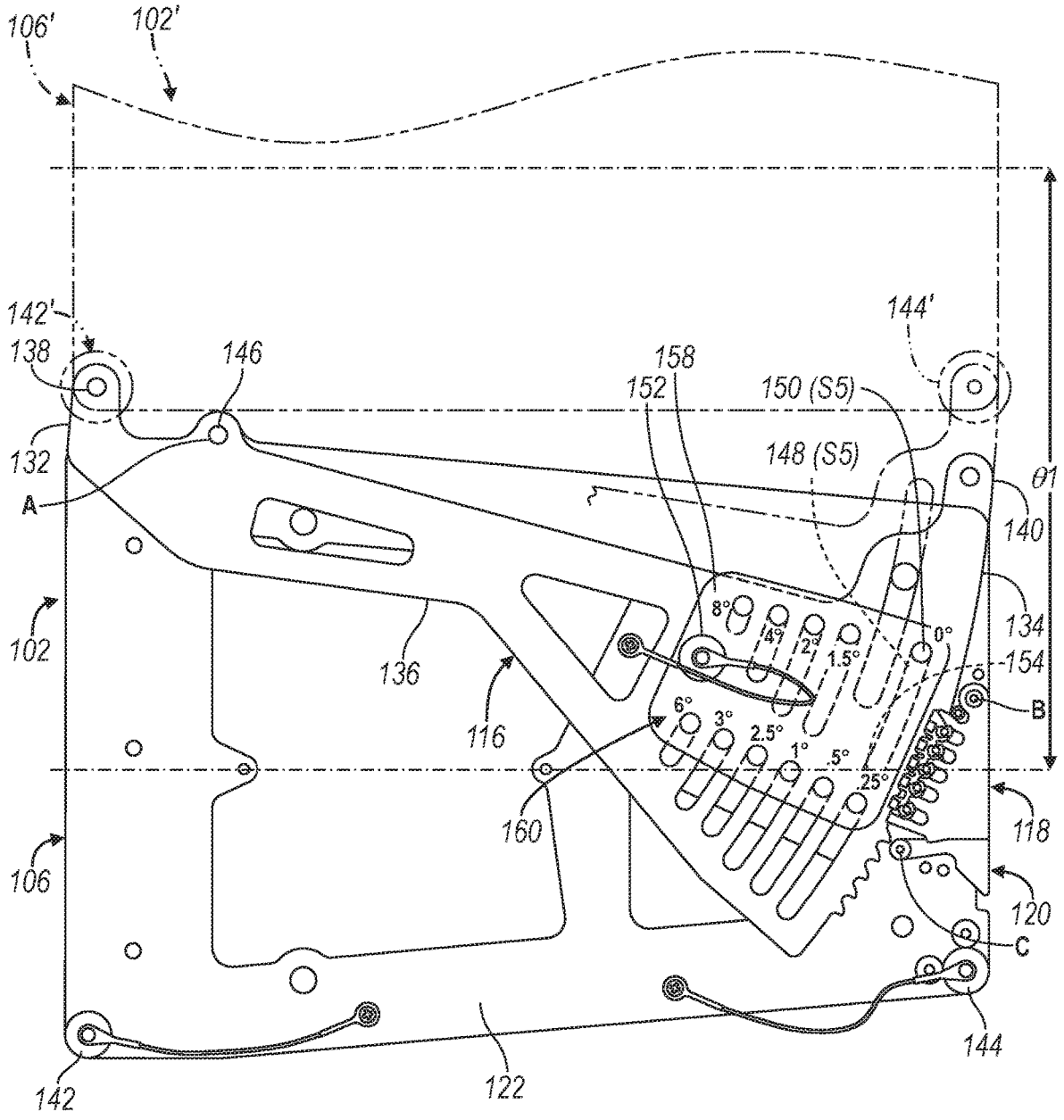
FIG. 3 is a side view of the suspension system of FIG. 2 without an outer plate, illustrating a locking mechanism.

Referring to FIG. 3, the lever arm 116 may be connected to the suspension system 106' of an upper vertically adjacent speaker assembly 102' for connecting the two speaker assemblies 102, 102' to each other. The lever arm 116 includes a proximal end 132, a distal end 134 and an intermediate portion 136 that extends between the proximal and distal ends 132, 134. The lever arm 116 also includes a front link 138 that extends from the proximal end 132 for connecting to a front end of the suspension system 106' of the vertically adjacent speaker assembly 102'. The lever arm 116 also includes a rear link 140 that extends from the distal end 134 for connecting to a rear end of the suspension system 106' of the vertically adjacent speaker assembly 102'. The vertically adjacent speaker assembly 102' includes a front pin 142' that may be inserted through apertures formed through the front link 138 and the front end of its suspension system 106' for connecting the front ends of the speaker assemblies 102, 102'. Similarly, the vertically adjacent speaker assembly 102' includes a rear pin 144' that may be inserted through apertures formed through the rear link 140 and the rear end of its suspension system 106' for connecting the rear ends of the speaker assemblies 102, 102'. The speaker assembly 102 also includes front and rear pins 142, 144 for connecting to a lower vertically adjacent speaker assembly (not shown), and the pins 142, 144 may be coupled to the frame 114 by a cable so that they are not misplaced.

The lever arm 116 is pivotally connected to the frame 114 for adjusting the splay angle (θ) between the speaker assembly 102 and the upper vertically adjacent speaker assembly 102'. The intermediate portion 136 of the lever arm 116 is pivotally connected to an upper intermediate portion of the frame 114 about a first pivot axis ("A"). A pivot pin 146 extends through apertures formed in the inner plate 122, the outer plate 124 and the lever arm 116 along axis A to provide a pivot point (see also FIG. 2). The lever arm 116 includes a plurality of arcuate slots 148 that are formed through the intermediate portion 136. Each slot 148 is formed in an arcuate shape at a common radius from axis A along its arc length. The inner plate 122 includes a plurality of apertures 150 that each align with one of the slots 148. The slots 148 and the apertures 150 are sized for receiving a splay angle selection pin 152. The splay angle selection pin 152 engages a lower end 154 of each slot 148, which provides an end stop for pivotal motion that corresponds to a splay angle of the speaker assembly 102 relative to the upper vertically adjacent speaker assembly 102'. Each slot 148 has a different slot length and corresponds to a different splay angle. The lever arm 116 also includes an aperture 156 (FIG. 2) that corresponds to another splay angle. Pivot axis A is offset from the front of the speaker assembly for acoustic reasons, according to one embodiment. It represents the true splay angle center of rotation, so the speakers are evenly distributed in the line array 108 regardless of their splay angle. And the gap between adjacent high frequency acoustic outputs is constant regardless of the splay angle value.

For example, in one embodiment, a user inserts the splay angle selection pin 152 through the aperture 150 and slot 148 that correspond to a splay angle selection of zero degrees, which is depicted by "S5" in FIG. 3. Then the user lifts the upper speaker assembly 102' and the lever arm 116 of the speaker assembly 102 pivots counterclockwise about axis A (as shown in FIG. 3) until the splay angle selection pin 152 contacts the end stop 154 of the slot 148. Next the speaker assembly 102 is adjusted to splay angle θ5, as depicted by the lever arm 116 and upper speaker assembly 102' shown in dashed line.

In the illustrated embodiment, the aperture 156 (shown in FIG. 2) corresponds to a maximum splay angle of ten degrees, which is selected for all speaker assemblies 102 in a line array 108 during transport, as depicted by transport array 108T in FIG. 1. An aperture 156 is used, rather than a slot, for the transport position to avoid any inadvertent splay angle adjustment during transport.

The suspension system 106 includes a sheet 158 with ornamental indicia 160 that represent the different splay angles available for selection, according to one embodiment. The sheet 158 is mounted to the external surface of the outer plate 124, as depicted in FIG. 2, and includes a plurality of apertures that align with the apertures 150 of the frame 114. As shown in FIG. 3, the ornamental indicia includes a label for each aperture 150 that indicates the corresponding splay angle. In one embodiment, the speaker assembly 102 includes a splay angle adjustment range between 0° and 10°. In another embodiment, the speaker assembly 102 includes splay angles of 0°, 0.25°, 0.5°, 1°, 1.5°, 2°, 2.5°, 3°, 4°, 6°, 8° and 10°.

Figure 5:
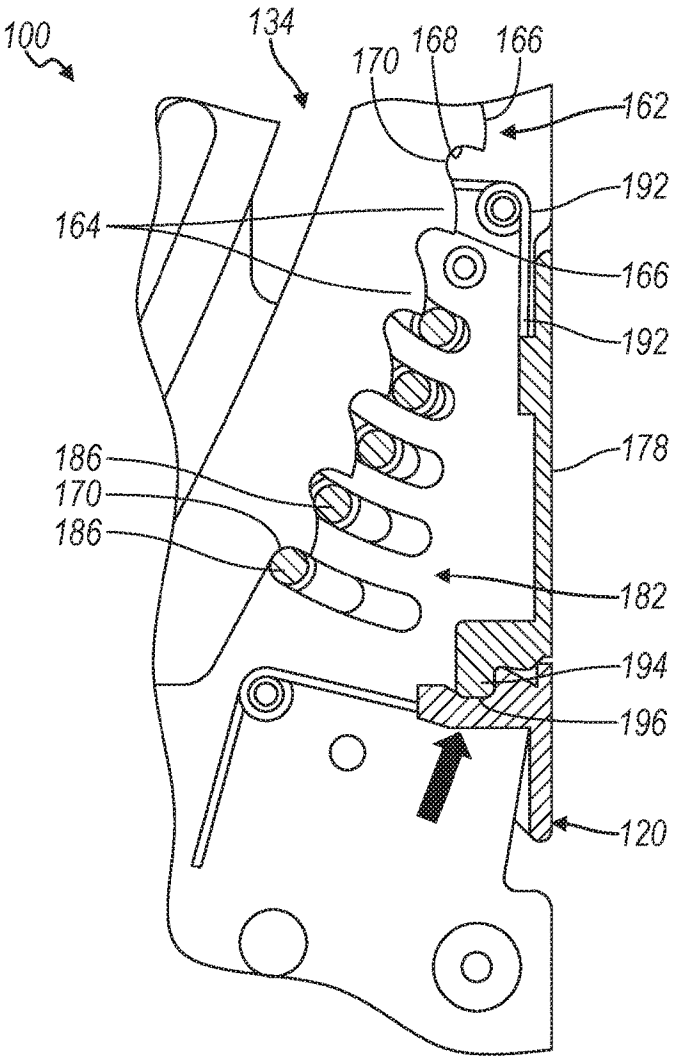
FIG. 5 is a vertical section view of the locking mechanism of FIG. 4.
Figure 4:
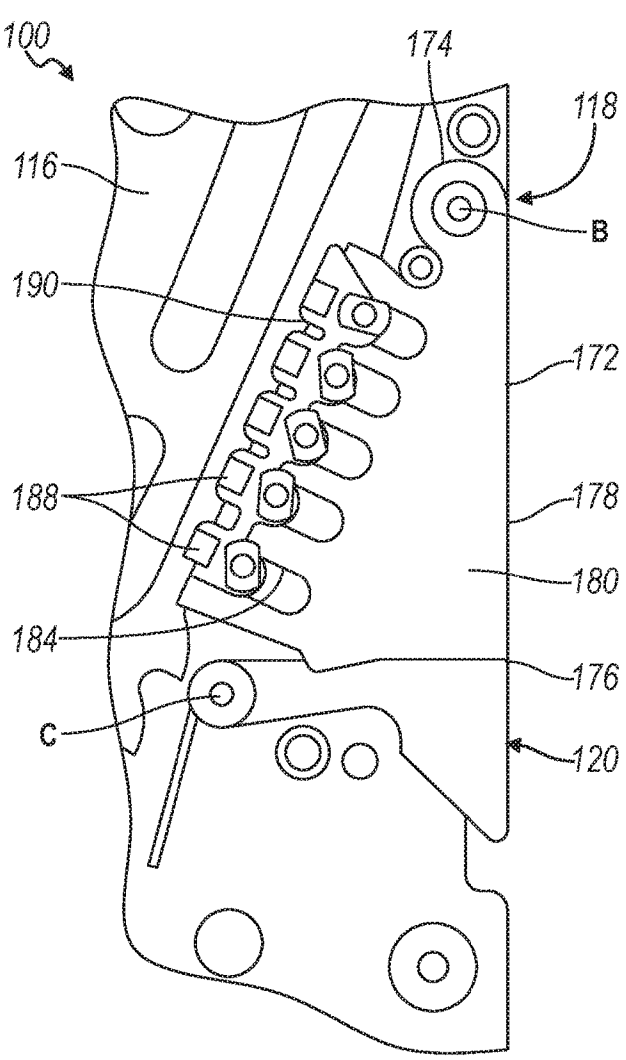
FIG. 4 is an enlarged view of the suspension system of FIG. 3, illustrating the locking mechanism in a locked position.

Referring to FIGS. 4-5, the locking mechanism 100 locks the lever arm 116 at its selected splay angle. The locking mechanism 100 includes the lever arm 116, the latch assembly 118 and the release lever 120. The distal end 134 of the lever arm 116 is formed in an arcuate shape with a sector 162 having a plurality of teeth 164 that extend radially outward. The teeth 164 are symmetrical in shape with respect to each other. And each tooth 164 is formed asymmetrical in shape with a moderate slope on a leading edge 166 and a steep slope on a trailing edge 168. A pocket 170 is formed between the trailing edge 168 of a first tooth 164 and the leading edge 166 of a second subsequent tooth 164.

The latch assembly 118 includes a lock lever 172 with a proximal end 174 and a distal end 176. The proximal end 174 is pivotally connected to an intermediate rear portion of the frame 114 about axis (B). The latch assembly 118 pivots about axis B between a locked position (shown in FIGS. 4-5) and a released position (shown in FIGS. 6-7).

The lock lever 172 also includes a base 178 and a pair of sides 180 that extend from opposing lateral edges of the base 178 to define a channel 182. The base 178 is oriented to align with a rear edge of the frame 114 and the sides 180 are spaced apart from each other to receive the plurality of teeth 164 within the channel 182 when the latch assembly 118 is oriented in the locked position (FIGS. 4-5). A plurality of slots 184 are formed through the sides 180 and each slot 184 is formed in an arcuate path at a different radius relative to axis B. The latch assembly 118 also includes a plurality of pins or pawls 186 that are supported by the plurality of slots 184 and sized to engage the plurality of teeth 164 within the pockets 170 to prevent pivotal motion of the lever arm 116 about axis A in a clockwise direction.

The latch assembly 118 includes a plurality of tabs 188 that extend transversely from an outer surface of the lock lever 172. In the illustrated embodiment, the tabs 188 are oriented adjacent to a forward end of each slot 184. The latch assembly 118 also includes a biasing member, such as carrier 190 that connects to each tab 188 and to an outer end of each pin 186. The carrier 190 is formed of a flexible material to bias the pins 186 forward to engage the plurality of teeth 164.

The locking mechanism 100 functions as a ratchet mechanism that allows the lever arm 116 to pivot in one direction when the speaker assembly 102 is suspended and limit pivotal motion in an opposite direction for locking the lever arm 116 at its selected splay angle. For example, as the lever arm 116 pivots counterclockwise, the leading edge 166 of a tooth 164 engages a pin 186 to translate the pin 186 rearward in the slot 184 and the carrier 190 elastically deforms under the tensile force to allow such motion. Then after the leading edge 166 of the tooth 164 passes, the carrier 190 returns to its normal position and pulls the pin 186 forward along the trailing edge 168 of the tooth 164 to the pocket 170, which locks the lever arm 116 to prevent pivotal motion in a clockwise direction. As shown in FIG. 5, the carrier 190 allows each pin 186 to translate individually, and one pin 186 is sufficient for locking the lever arm 116. Such individual adjustment of the pins 186 reduces backlash of the locking mechanism 100.

The release lever 120 engages the latch assembly 118 to maintain the locked position, as shown in FIGS. 4-5. The latch assembly 118 includes a spring 192 that biases the lock lever 172 away from the sector 162 to the released position (shown in FIGS. 6-7). In the illustrated embodiment, the spring 192 is a torsion spring oriented about axis B with a free leg that engages the base 178 within the channel 182 when the lock lever 172 is oriented in the locked position (shown in FIG. 5) to create the spring force. The lock lever 172 also includes a latch 194 that extends radially outward from the distal end 176. The latch 194 engages a groove or keeper 196 formed into an upper surface 198 of the release lever 120 for maintaining the latch assembly 118 in the locked position (shown in FIG. 5).

Figure 7:
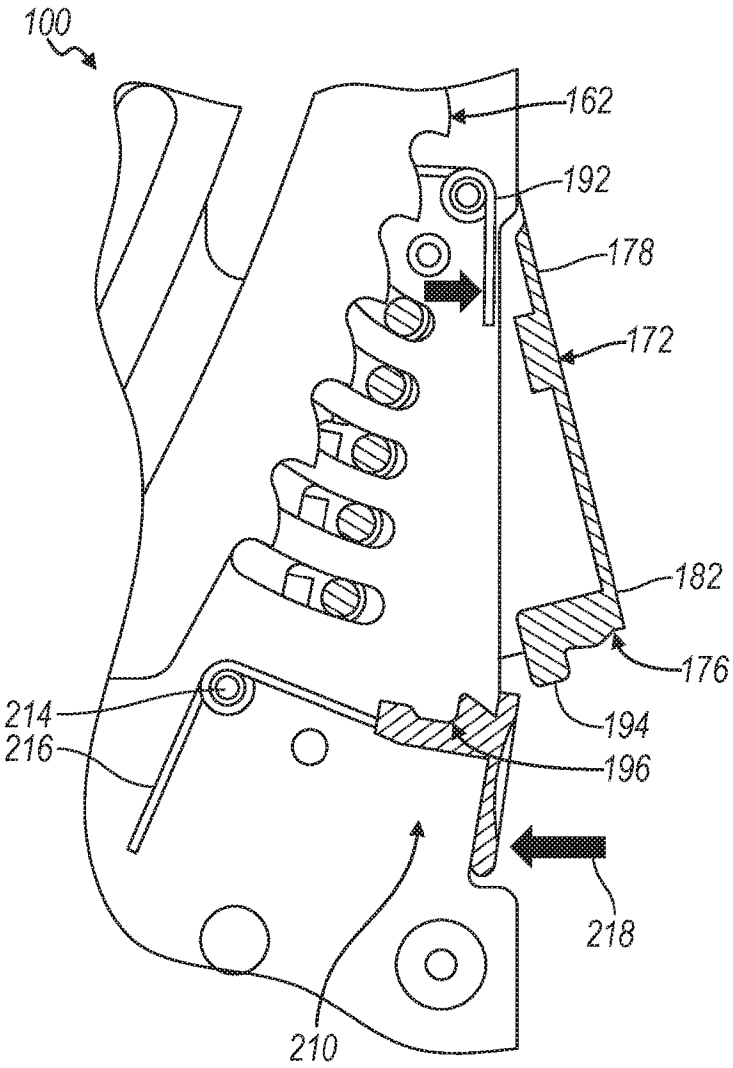
FIG. 7 is a vertical section view of the locking mechanism of FIG. 6.
Figure 6:
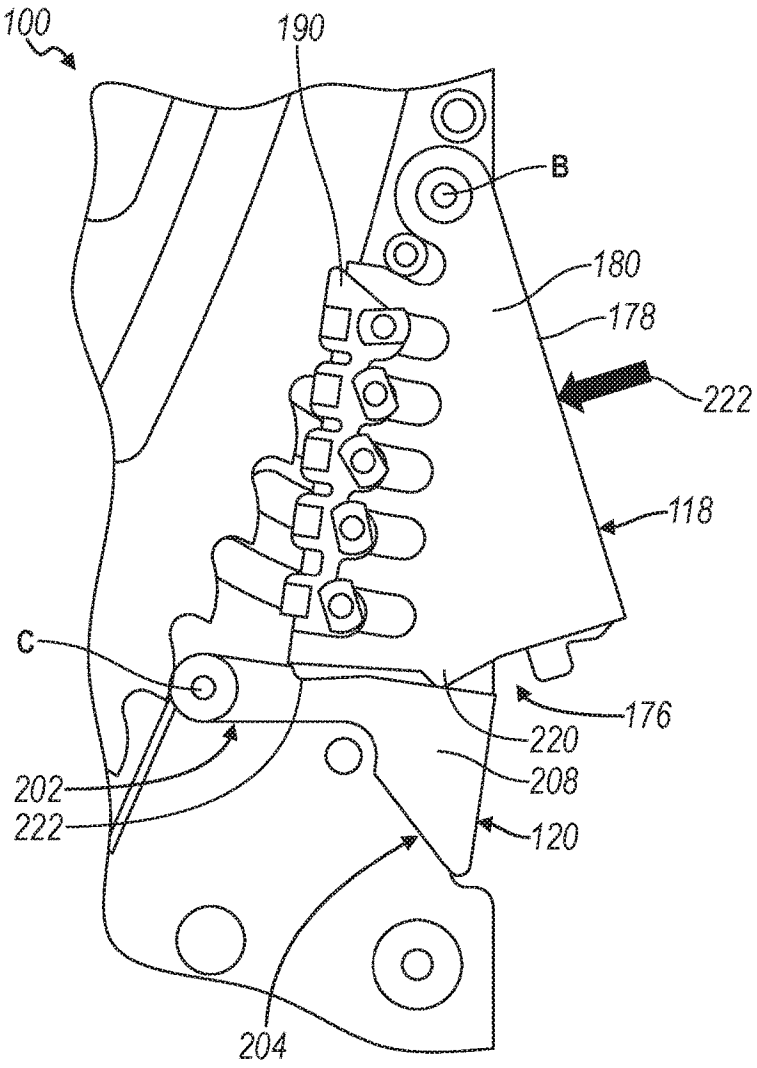
FIG. 6 is an enlarged view of the suspension system of FIG. 3, illustrating the locking mechanism in a released position.

With reference to FIGS. 6-7, the release lever 120 disengages the latch assembly 118 to allow the locking mechanism 100 to adjust to the released position. The release lever 120 includes a proximal end 202 and a distal end 204. The release lever 120 also includes a base 206 formed at the distal end 204 and a pair of sides 208 that extend from the base 206 to the proximal end 202. The sides 208 are laterally spaced apart from each other to define a cavity 210. In the illustrated embodiment, a rearward portion of the inner plate 122 and outer plate 124 are received in the cavity 210, and the upper surface 198 extends from the base 206 between the plates 122, 124. The release lever 120 includes apertures 212 formed through the sides 208 at the proximal end 202 that are sized to receive a pin 214 that is oriented at axis C. The pin 214 provides a pivotal connection for the release lever 120 about axis C. The locking mechanism 100 includes a spring 216 that is coupled to the frame 114 about the pin 214 to bias the release lever 120 to engage the latch 194 of the lock lever 172 for maintaining the latch assembly 118 locked position (shown in FIG. 5). In the illustrated embodiment, the spring 216 is a torsion spring oriented about the pin 214 with a free leg that engages the upper surface 198 of the release lever 120 to provide the spring force. The release lever 120 pivots clockwise about axis C when subjected to an external force 218 acting on a lower portion of the base 206. Once the release lever 120 pivots far enough, the keeper 196 disengages from the latch 194, and the latch assembly 118 pivots counterclockwise to the released position, as shown in FIGS. 6-7.

The locking mechanism 100 maintains the released position until it is reset. The latch assembly 118 includes projections 220 that extend radially outward from the sides 180 at the distal end 176 of the lock lever 172. As shown in FIG. 6, the projections 220 engage an upper surface of the sides 208 of the release lever 120, and the spring force provided by the release spring 216 maintains the released position. To reset the locking mechanism 100 back to the locked position (shown in FIGS. 4-5), the user applies an external force 222 to the base 178 of the lock lever 172, which pivots the release lever 120 further clockwise and acts against the release spring 216, until the projections 220 reach an indentation 224 formed in the release lever 120, and the release lever 120 rotates counterclockwise to engage the latch 194 (shown in FIG. 4).

Figure 8:
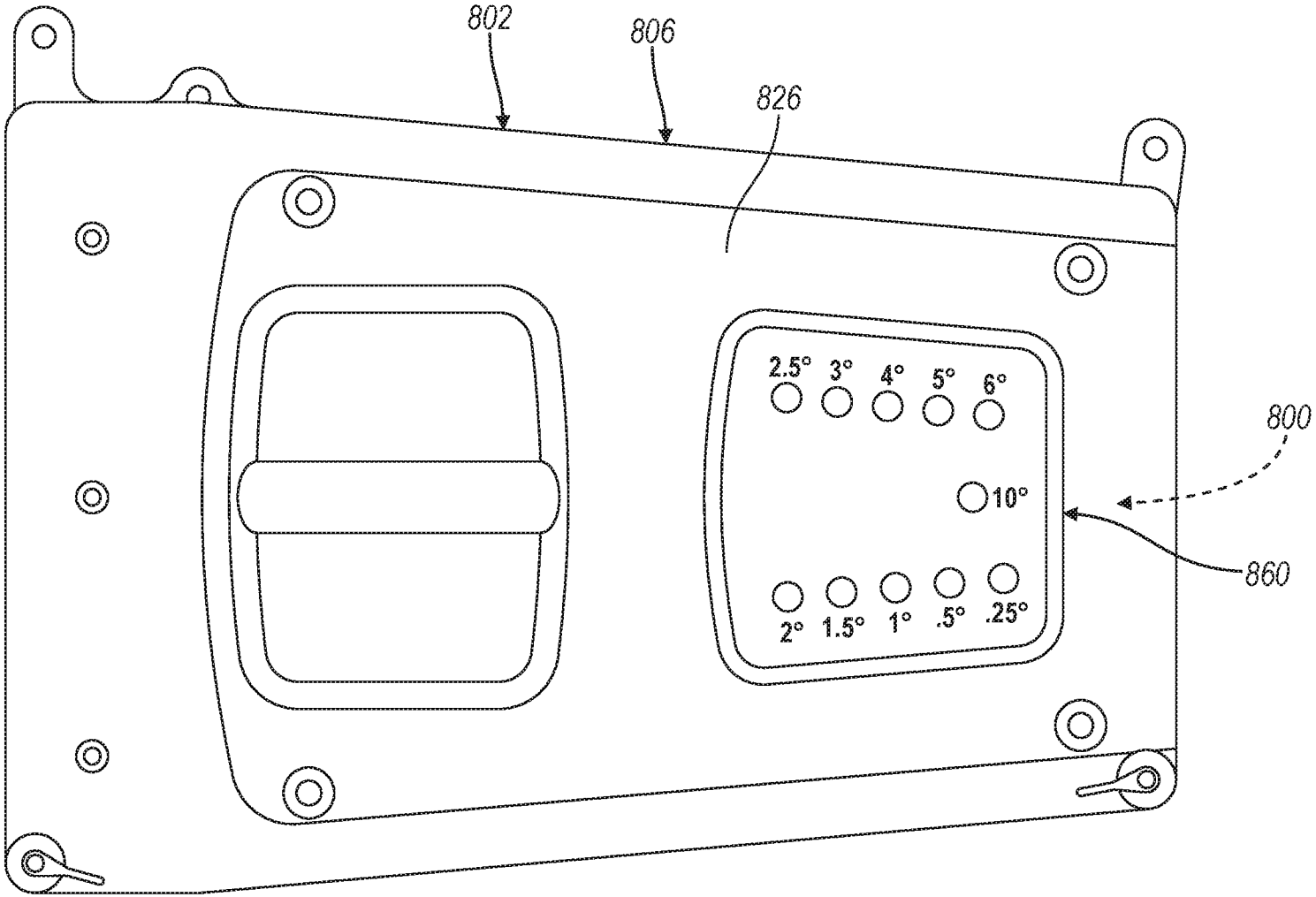
FIG. 8 is a front view of a suspension system of a speaker assembly of FIG. 1, according to another embodiment.
Figure 9:
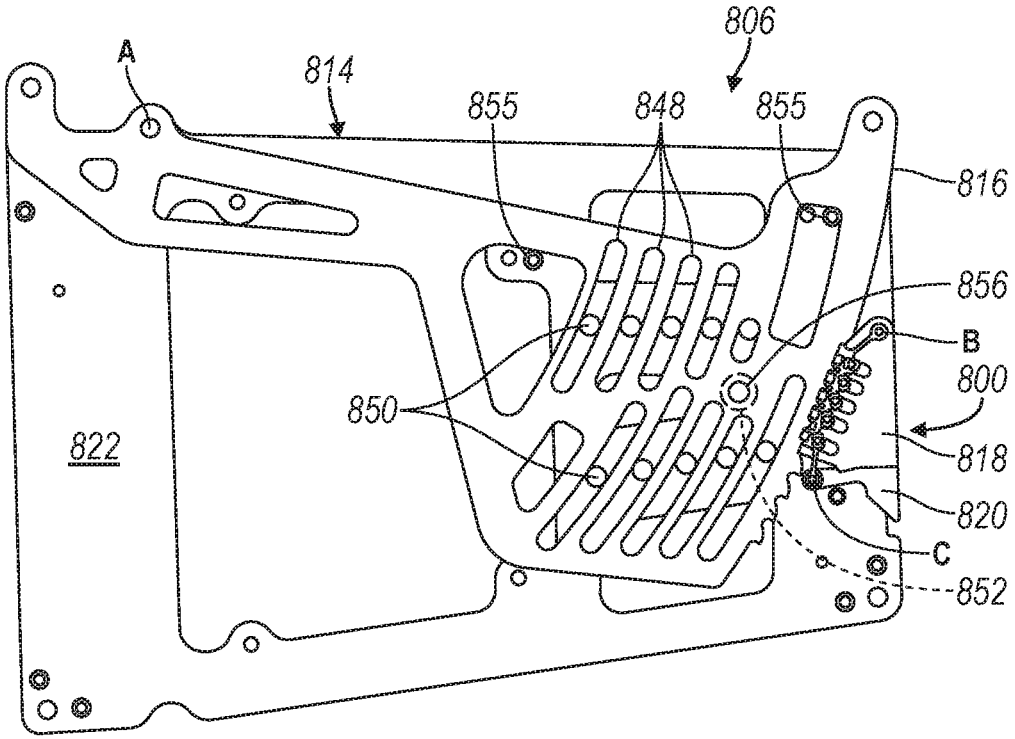
FIG. 9 is a front view of a portion of the suspension system of FIG. 8, illustrating a locking mechanism adjusted to a first splay angle.
Figure 10:
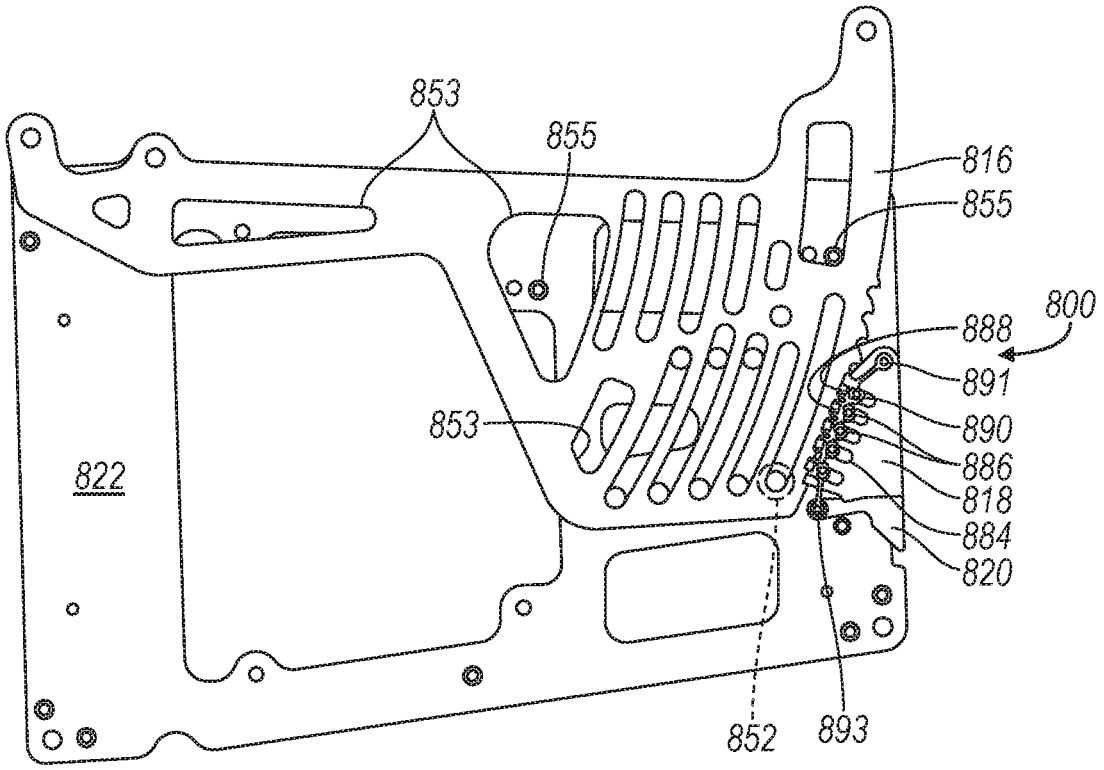
FIG. 10 is another front view of a portion of the suspension system of FIG. 8, illustrating the locking mechanism adjusted to a second splay angle.

With reference to FIG. 8-10, a locking mechanism 800 for a speaker assembly 802 is illustrated in accordance with one or more embodiments and is generally represented by numeral 800. The speaker assembly 802 includes a suspension system 806 that is similar to the suspension system 106 described with reference to FIGS. 1-7.

With reference to FIGS. 9-10, the suspension system 806 includes a frame 814 and the locking mechanism 800. The frame 814 is mounted a side surface of the speaker assembly 802. The locking mechanism 800 includes a lever arm 816, a latch assembly 818 and a release lever 820. The lever arm 816 is pivotally connected to an intermediate portion of the frame 814 about a first pivot axis ("A") with a sector formed at a distal end including a plurality of teeth. The lever arm 816 includes a plurality of slots 848 that are formed at different radial distances from axis-A that each correspond to a different splay angle. The frame 814 includes a plurality of apertures 850 that each align with one of the slots 848. The lever arm 816 also includes an aperture 856 that corresponds to a transport splay angle, rather than a slot. The suspension system 806 includes a pin 852 that is inserted through an aperture 850 and slot 848 for selecting a splay angle.

FIGS. 9 and 10 illustrate the splay angle adjustment range of the suspension system 806. The suspension system 806 of the illustrated embodiment is adjustable between 0.25-10°. FIG. 9 illustrates a splay angle selection of 10° and a splay angle adjustment of 10°. The pin 852 is inserted through the aperture 850 and transport aperture 856 corresponding to 10°; and the lever arm 816 is adjusted to the selected splay angle (10°). FIG. 10 illustrates a splay angle selection of 0.25°, and a splay angle adjustment of 0.25°. The pin 852 is inserted through the aperture 850 and slot 848 corresponding to 0.25°, and the lever arm 816 is adjusted to the selected splay angle (0.25°).

The suspension system 806 includes travel limiter features according to one or more embodiments. The lever arm 816 includes a plurality of openings 853 that are formed adjacent to the slots 848 which reduce the mass of the lever arm 816. The suspension system 806 includes posts 855 that are supported by the inner and outer plates 822, 844 and extend through the openings 853.

As shown in FIG. 9, the posts 855 engage the lever arm 816 at an upper portion of the openings 853 to limit further clockwise motion of the lever arm about axis A. As shown in FIG. 10, the rearward post 855 engages the lever arm 816 at a lower portion of a rearward opening 853 to limit further counterclockwise motion of the lever arm about axis A.

Referring to FIGS. 8-10, the suspension system 806 includes a different cover 826 and splay angle hole pattern than the suspension system 106 illustrated in FIGS. 1-7. As shown in FIG. 8, the cover 826 is a one-piece cover, as compared to the two-piece cover 126, 130 of the suspension system 106. The speaker assembly 802 includes a splay angle adjustment range between 0.25° and 10°, and the splay angle selections are arranged in increasing order from lowest angle (0.25°) to largest angle 10° in a clockwise orientation, as depicted by the ornamental indicia 860 illustrated in FIG. 8.

With reference to FIG. 9, the latch assembly 818 is pivotally connected to an end portion of the frame 814 about a second pivot axis ("B") with a plurality of pins to engage the plurality of teeth of the lever arm 816 for maintaining the selected splay angle. The latch assembly 818 is spring biased away from the sector to a release position. The release lever 820 is pivotally connected to the end portion of the frame about a third axis ("C") and adjacent to the sector. The release lever 820 is spring biased toward the latch assembly 818 to maintain engagement of the pins with the teeth in a lock position.

Referring to FIG. 10, the latch assembly 818 includes a carrier 890 that connects to the release lever 820. The latch assembly 818 includes a plurality of tabs 888 that extend transversely from an outer surface of the lock lever 872. The tabs 888 are oriented adjacent to a forward end of each slot 884. The latch assembly 818 also includes a carrier 890 that connects to each tab 888 and to an outer end of each pin 886. The carrier 890 also connects to a pin 891 oriented at axis B and to a pin 893 oriented at axis C of the release lever 820, which eliminates individual clips for retaining the pins 891, 893. The carrier 890 is formed of a flexible material and biases the pins 886 forward to engage the plurality of teeth 864.

The locking mechanisms 100, 800 allow a user to select the splay angle for each speaker assembly in a line array before it is suspended. The locking mechanism 100, 800 provides simple and intuitive connections between speaker systems (always the same points to connect, one pin at each corner of the speaker system, which means that connecting speakers together is independent from splay angle selection, thus clearly separating both procedures). Choosing a splay angle can be done prior to occupying the space at the venue which is often accessible for only a limited time. As a result, the sound crew will setup the array faster once on location. The locking mechanism 100, 800 locks the splay angle as the speakers are lifted off the ground.

Figure 11:
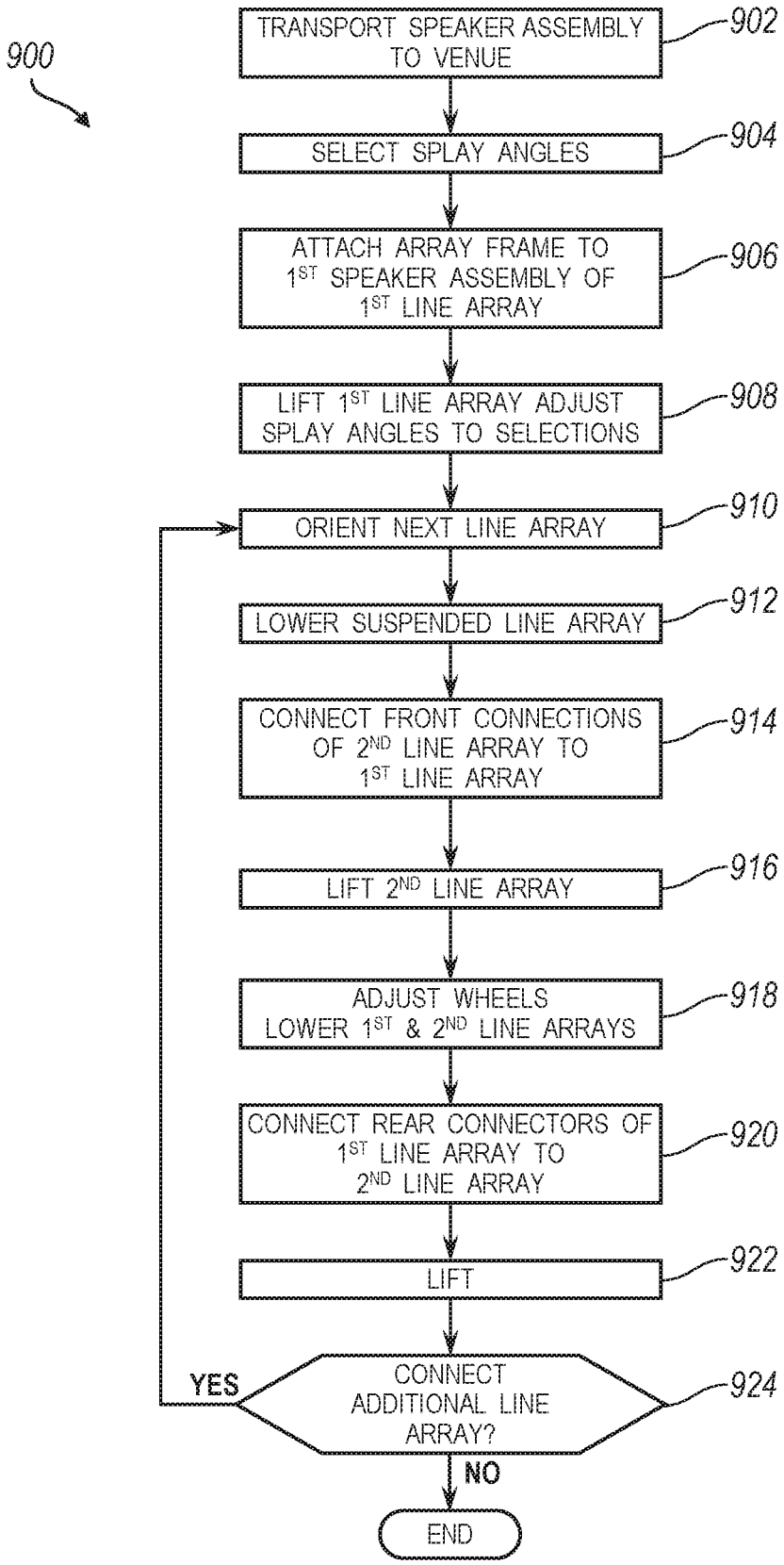
FIG. 11 is a flow chart illustrating a method for assembling the line array of FIG. 1.

FIG. 11 is a flow chart illustrating a method 900 for assembling a line array of speaker assemblies 102, 802 according to one or more embodiments. And FIGS. 12-22 illustrate the operations of the method 900 for assembling a line array according to one or more embodiments.

At operation 902, the speaker assemblies 102, 802 are arranged in line arrays 108 and transported to a venue, such as a stage. At operation 904, the user selects a splay angle for each speaker assembly 102. Then at operation 906, the user attaches the array frame 112 to the top speaker assembly 102 of the first line array 108A. At operation 908, the user lifts the first line array 108A, and once the lowermost speaker assembly 102 is suspended, the user disconnects the cart 110.

Figure 12:
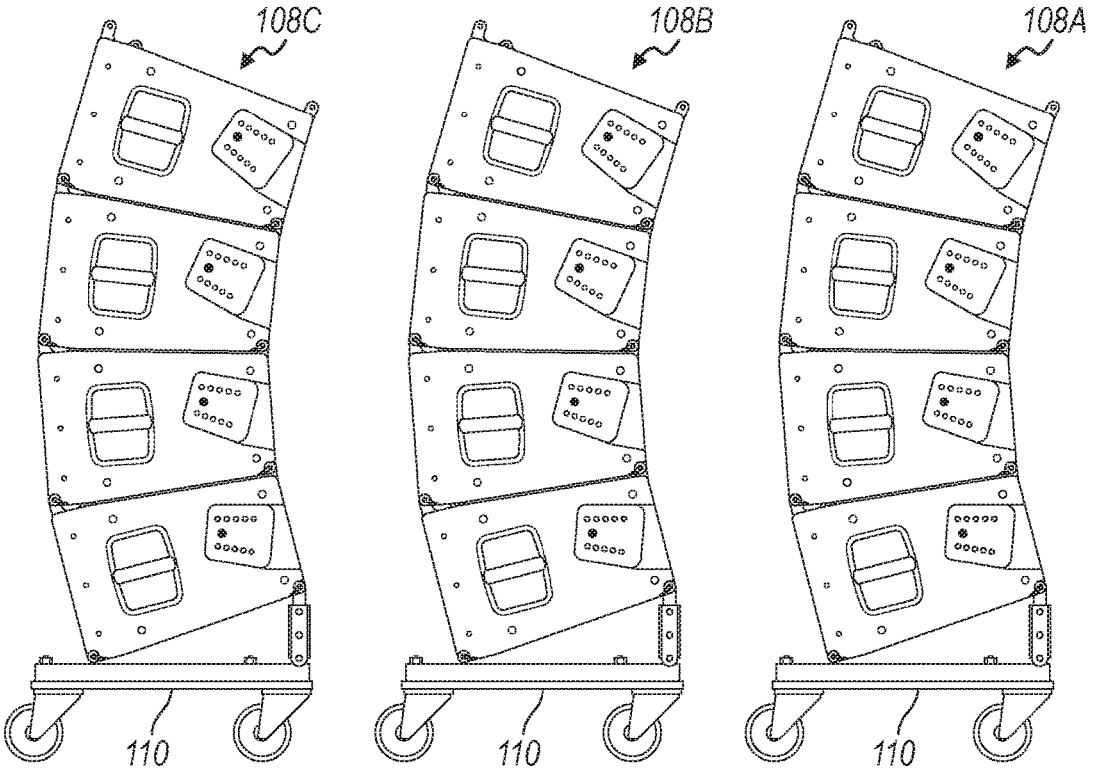
FIG. 12 is a side schematic view of three line arrays of speaker assemblies, illustrating a step of the method of FIG. 11.
Figure 13:
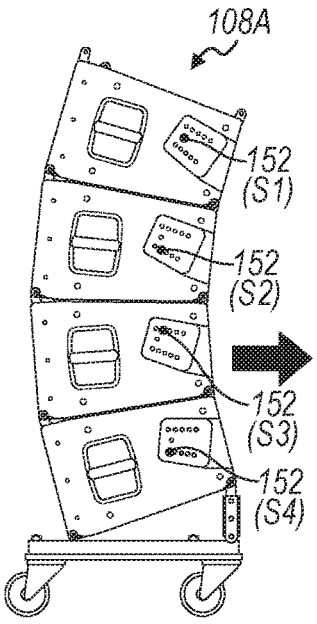
FIG. 13 is a side schematic view of a first line array of FIG. 12, illustrating another step of the method of FIG. 11.
Figure 14:
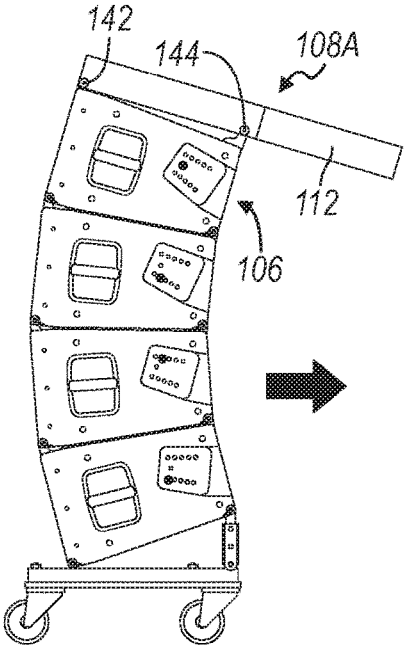
FIG. 14 is another side schematic view of the first line array of FIG. 12, illustrating another step of the method of FIG. 11.
Figure 15:
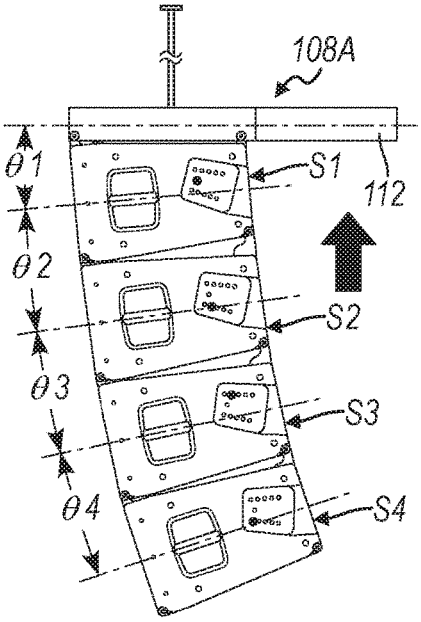
FIG. 15 is another side schematic view of the first line array of FIG. 12, illustrating another step of the method of FIG. 11.

FIGS. 12-15 illustrate operations 902-908. Referring to FIG. 12, a plurality of speaker assemblies 102 are stacked vertically on each cart 110 to form three line arrays 108A, 108B and 108C (Operation 902). Then a splay angle for each speaker assembly 102 is selected by inserting the splay angle selection pin 152 into the corresponding aperture 150, i.e., S1, S2, S3 and S4 as shown in FIG. 13 (Operation 904). Next, as shown in FIG. 14, the array frame 112 is attached to the uppermost speaker assembly 102 using a front pin 142 and a rear pin 144 for each suspension system 106 (Operation 906). With reference to FIG. 15, the array frame 112 is connected to a motor by a sling or chain to lift the stack of speaker assemblies 102 up until the wheels of the cart 110 are off the ground (Operation 908). At this point, the speaker assemblies 102 on the cart 110 will deploy and adjust to their selected splay angles, i.e., θ1, θ2, θ3 and θ4. Then the cart 110 is disconnected.

Referring to FIG. 11, at operation 910, the user orients the subsequent line array 108B underneath the suspended line array 108A. At operation 912, the user lowers the suspended line array 108A. At operation 914, the user connects the front end of the suspended line array 108A with the front end of the subsequent line array 108B. Then at operation 916, the user lifts the line arrays 108A, 108B, and the splay angles of the second line array 108B adjust to their selected splay angles. At operation 918, the user adjusts the front wheels of the cart 110 that is connected to the subsequent line array 108B so that they are locked or transverse, and then pivots the lowermost line array 108B about the front connection while lowering the line arrays 108A, 108B until the front wheels contact the ground. After the front wheels contact the ground, the lower subsequent line array 108B will further pivot about the front connection until the rear connection of the subsequent line array 108B aligns with the rear connection of the suspended line array 108A. At operation 920, the user connects the rear end of the subsequent line array 108B with the rear end of the suspended line array 108A. At operation 922, the user lifts the suspended line array 108A, 108B. Now at operation 924, the user determines if they want to connect any additional subsequent line arrays, e.g., the third line array 108C. And if so, the user returns to operation 910 to perform operations 910-922.

Figure 16:
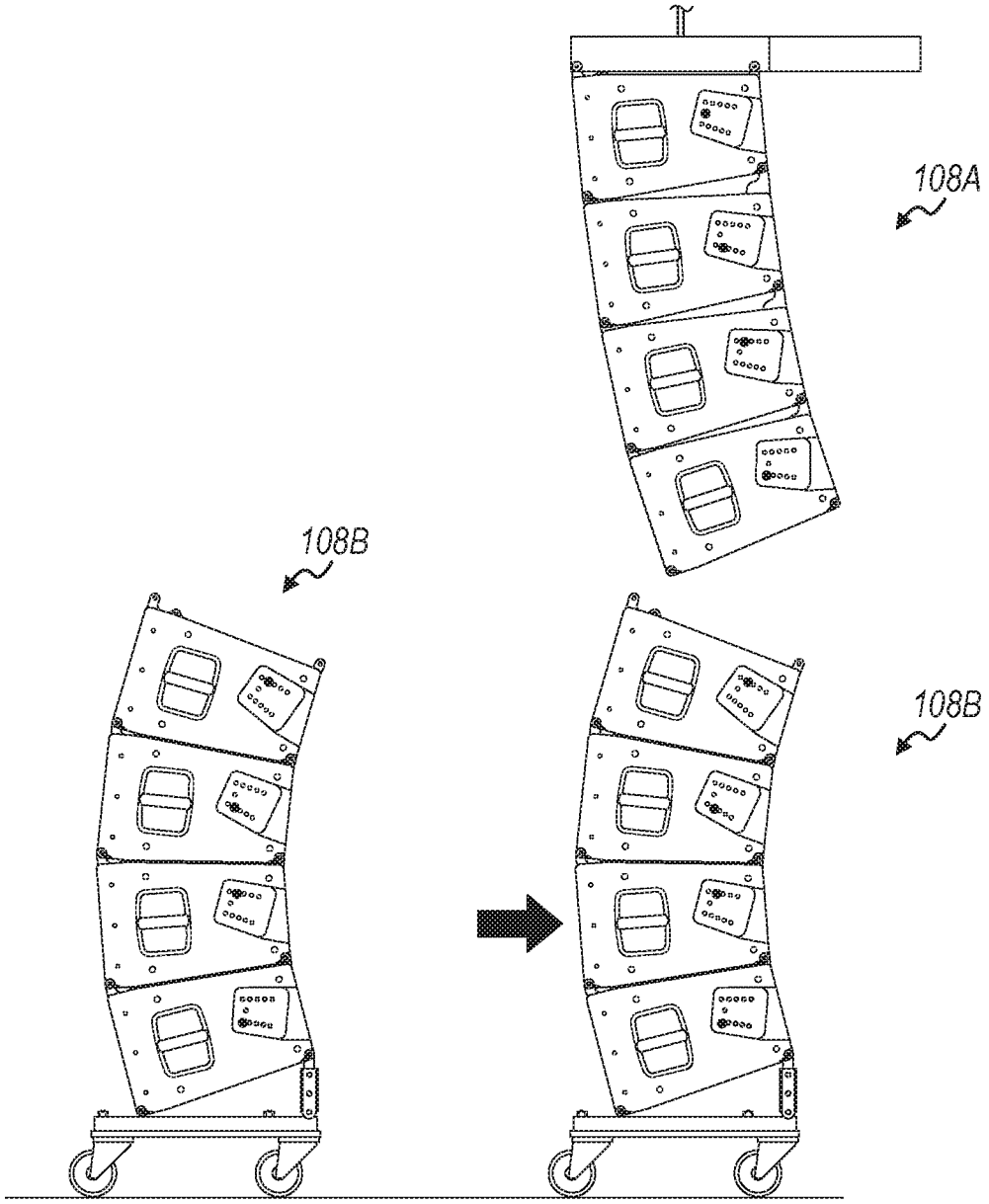
FIG. 16 is a side schematic view of the first line array and a second line array of FIG. 12, illustrating another step of the method of FIG. 11.
Figure 17:
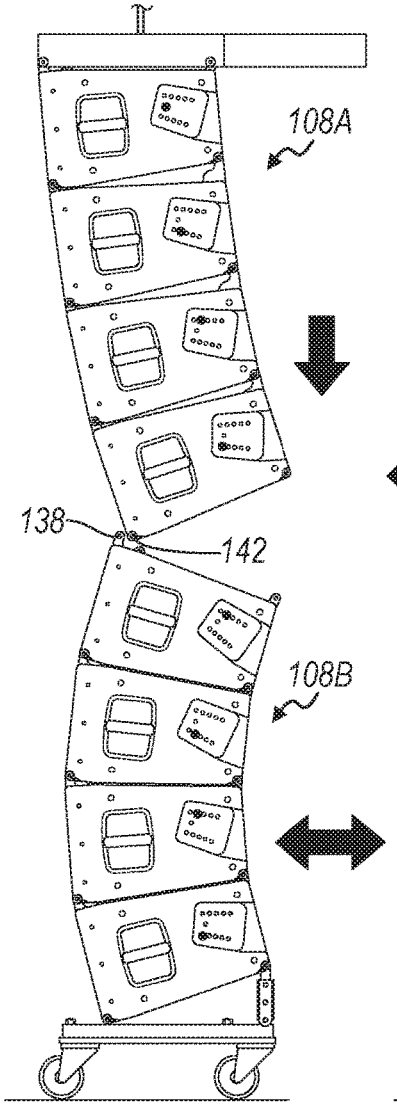
FIG. 17 is another side schematic view of the first line array and the second line array of FIG. 12, illustrating another step of the method of FIG. 11.
Figure 18:
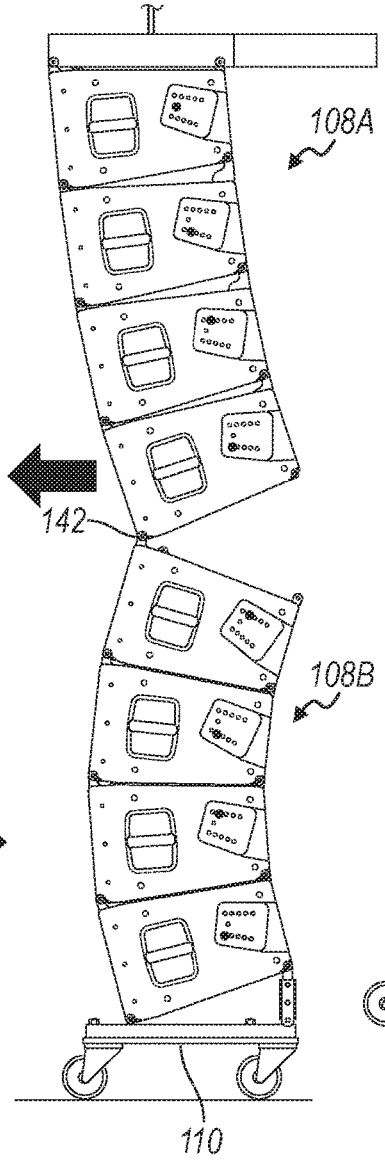
FIG. 18 is another side schematic view of the first line array and the second line array of FIG. 12, illustrating another step of the method of FIG. 11.
Figure 19:
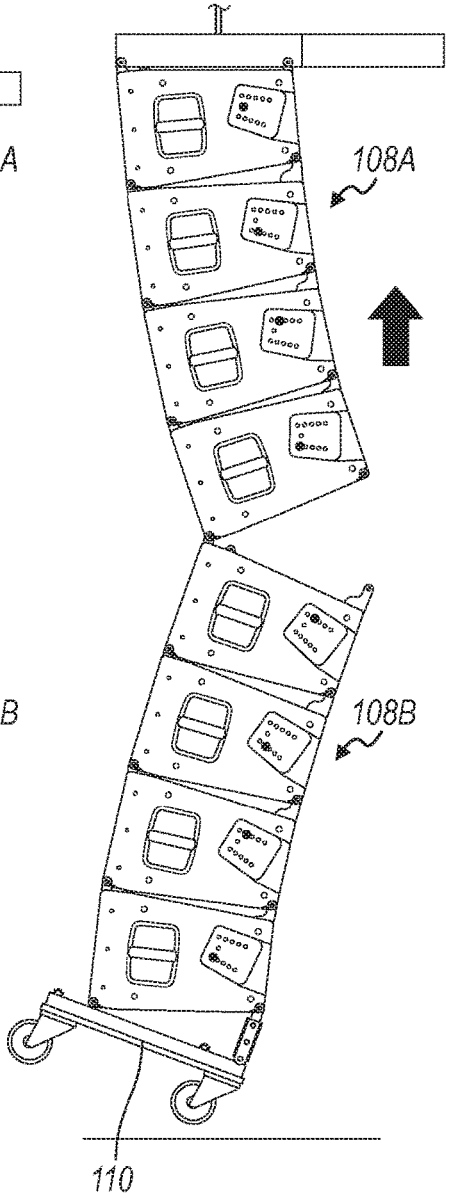
FIG. 19 is another side schematic view of the first line array and the second line array of FIG. 12, illustrating another step of the method of FIG. 11.
Figure 20:
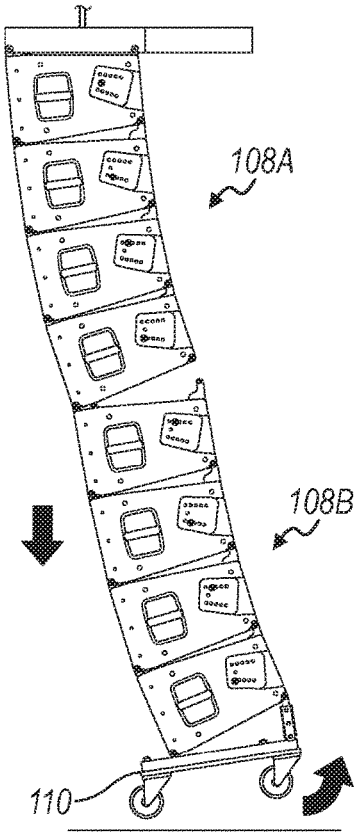
FIG. 20 is another side schematic view of the first line array and the second line array of FIG. 12, illustrating another step of the method of FIG. 11.
Figure 21:
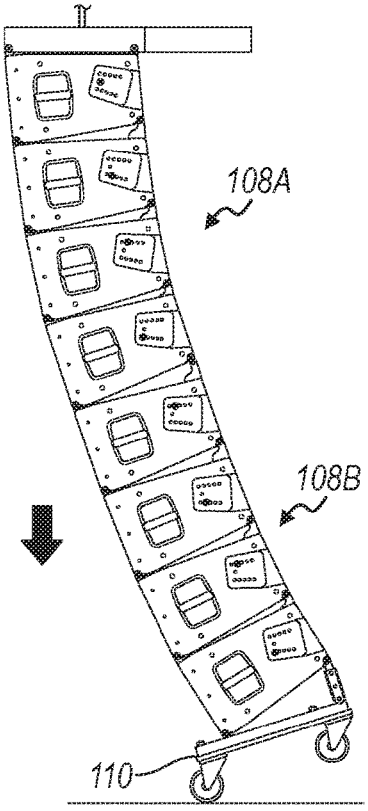
FIG. 21 is another side schematic view of the first line array and the second line array of FIG. 12, illustrating another step of the method of FIG. 11.
Figure 22:
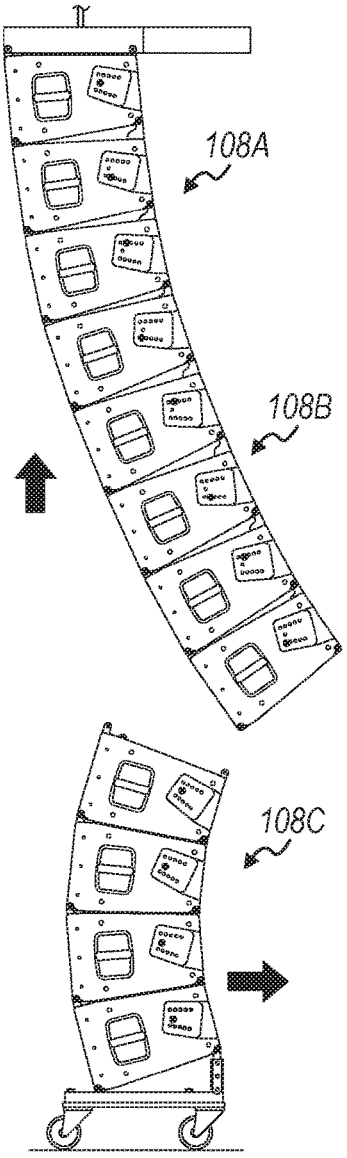
FIG. 22 is a side schematic view of the first line array, the second line array and a third line array of FIG. 12, illustrating another step of the method of FIG. 11.

FIGS. 16-19 illustrate connecting a second stack of speaker assemblies 102 (line array 108B) to the first line array 108A as described in operations 910-922. First, as shown in FIG. 16, the second line array 108B of speaker assemblies 102 is oriented such that the front is placed slightly forward from the front of the speaker line array 108A already flown (Operation 910). Next, the first line array 108A is lowered so that the bottom front corner of the array 108A is at the same height as the front corner (front link 138) of the lever arm 116 of the top speaker of the second line array 108B (Operation 912), as shown in FIG. 17. Next the first line array 108A is swung forward to align the adjacent corners and then they are connected to each other using a fastener, such as a quick-release front pin 142 (Operation 914), as shown in FIG. 18. Then the line arrays 108A, 108B, including the first and second stacks of speaker assemblies 102, are lifted up until the wheels of the cart 110 are lifted from the ground (Operation 916), as shown in FIG. 19. At this point the four speaker assemblies 102 of the second line array 108B will deploy and their respective splay angles will lock in. Referring to FIGS. 20-21, next the front wheels of the cart 110 are rotated so they are oriented transversely, and then the second (lower) line array 108B of speaker assemblies 104 is rotated backwards and the line arrays 108A, 108B are lowered until the front end of the cart 110 contacts the ground (Operation 918). Then the lower line array 108B rotates until the rear corners (rear links 140) engage with each other and can be secured using the rear fasteners, such as quick release rear pins 144 (Operation 920). Then, as shown in FIG. 22, the line arrays 108A, 108B are lifted and another stack of speakers 108C is connected.

Figure 23:
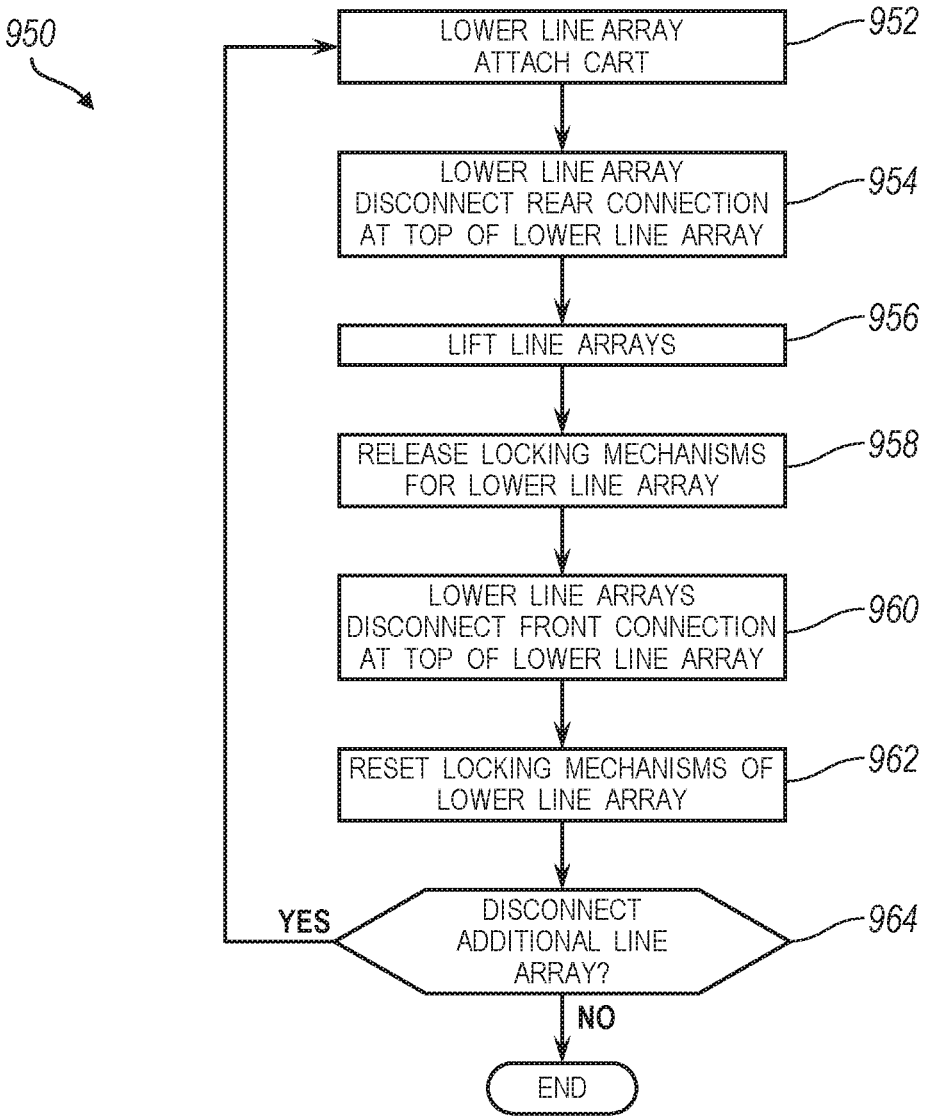
FIG. 23 is a flow chart illustrating a method for disassembling the line array of FIG. 22.
Figure 24:
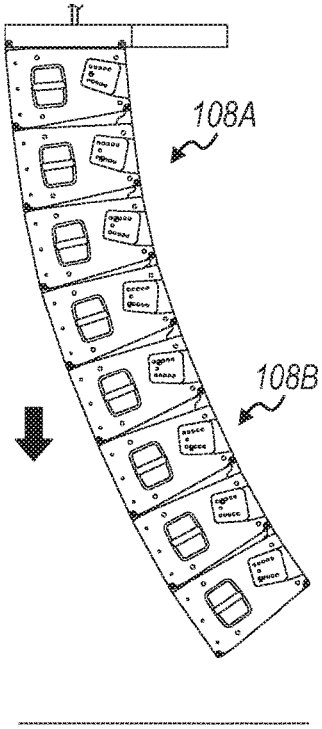
FIG. 24 is a side schematic view of the first line array and the second line array of FIG. 12, illustrating a step of the method of FIG. 23.
Figure 25:
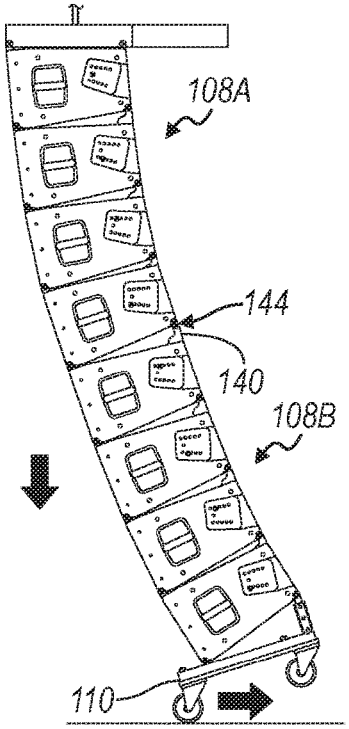
FIG. 25 is another side schematic view of the first line array and the second line array of FIG. 12, illustrating another step of the method of FIG. 23.

FIG. 23 is a flow chart illustrating a method 950 for disassembling a line array of speaker assemblies 102, 802 according to one or more embodiments. And FIGS. 24-27 illustrate the method 950 for disassembling a line array according to one or more embodiments.

At operation 952, the user lowers the line array(s) 108 (e.g., a line array that includes a first line array 108A and a second line array 108B connected below the first line array) and attaches the cart 110 to the lowermost speaker assembly 102. At operation 954, the user lowers the line arrays 108 further until the cart 110 contacts the ground, and then disconnects the rear connection between the first line array 108A and the second line array 108B. At operation 956, the user lifts the line arrays 108A, 108B until the cart 110 lifts off of the ground. At operation 958, the user releases the locking mechanism 100 for each speaker assembly 102 of the second line array 108B. Then at operation 960, the user lowers the line arrays 108A, 108B until the cart 110 contacts the ground, and then disconnects the front connection between the first line array 108A and the second line array 108B. At operation 962, the user resets the locking mechanism 100 for each speaker assembly 102 of the second line array 108B and moves the second line array away from the venue/stage. At operation 964, the user determines if they want to disassemble any additional line arrays. If so, the user returns to operation 952 and repeats operations 952-964.

Figure 26:
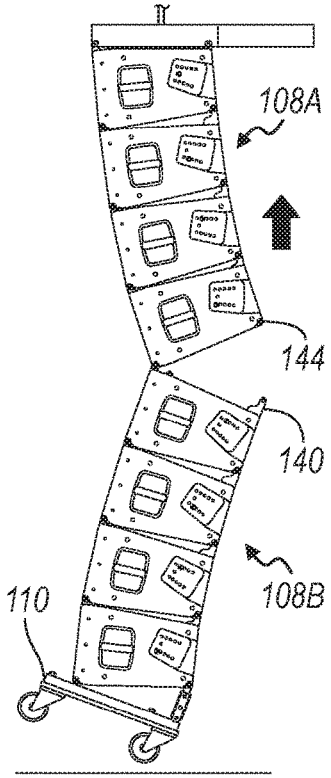
FIG. 26 is another side schematic view of the first line array and the second line array of FIG. 12, illustrating another step of the method of FIG. 23.

FIG. 24-27 illustrate disconnecting a second stack of speaker assemblies 102 (line array 108B) from the first line array 108B as described in the method 950. First, with reference to FIGS. 24-25, the line arrays 108A, 108B are lowered and the cart 110 is connected to the lowermost speaker assembly 102 (Operation 952). Then the wheels are turned transversely. Next, the line arrays 108A, 108B are lowered until the front wheels of the cart 110 contact the ground, and then the rear pin 144 of the 5th speaker assembly 102 from the bottom of the array (i.e., the top speaker assembly 102 of the lower speaker array 108B) is removed (Operation 954). Then, as shown in FIG. 26, the line arrays 108A, 108B are raised until the lower line array 108B of four speaker assemblies 102 hang from the front pins 142 of the 5th speaker assembly 102 (Operation 956).

Figure 27:
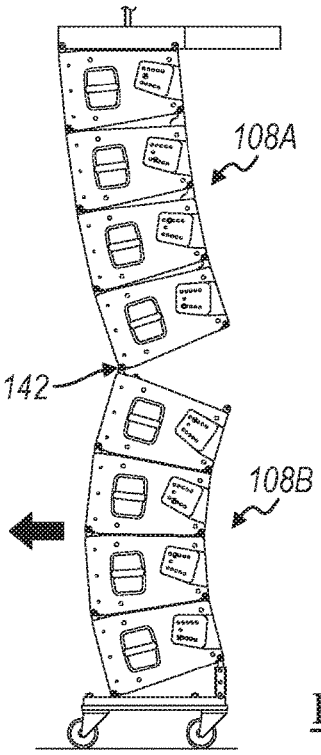
FIG. 27 is another side schematic view of the first line array and the second line array of FIG. 12, illustrating another step of the method of FIG. 23.

With reference to FIG. 27, the user presses the release lever 120 on each of the four bottom speaker assemblies 102 to release the locking mechanisms 100, as described above with reference to FIGS. 6-7 (Operation 958). Next, the line arrays 108A, 108B are lowered until the lower line array 108B contacts the ground and the front pins 142 are removed (Operation 960). Then the weight of the speaker assemblies 102 of the second line array 108B collapses the splay angles. Next, as described above with reference to FIGS. 6-7, the user pushes the lock lever 172 inward and flush with the cabinet 104 to lock the suspension system 106 in the stow position and removes the second line array 108B of speaker assemblies 102 (Operation 962).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for installation of a line array of speaker assemblies comprising:

providing a first line array with at least two stacked speaker assemblies and suspension systems, wherein the two stacked speaker assemblies are oriented at an initial splay angle;

selecting an installation splay angle between the at least two stacked speaker assemblies while the two stacked speaker assemblies are oriented at the initial splay angle;

connecting the suspension system of an uppermost speaker assembly of the at least two stacked speaker assemblies to a support;

raising the support to lift the at least two stacked speaker assemblies, whereby a lower speaker assembly pivots from the uppermost speaker assembly to adjust from the initial splay angle to the installation splay angle;

providing a second set of speaker assemblies with suspension systems;

orienting the second set of speaker assemblies below the first line array;

lowering the first line array;

connecting the suspension system of an uppermost speaker assembly of the second set of speaker assemblies to the suspension system of a lowermost speaker assembly of the first line array about a first connection; and raising the support to lift the first line array and the second set of speaker assemblies.

2. The method of claim 1, wherein selecting the installation splay angle further comprises inserting a pin through the suspension system of one of the at least two stacked speaker assemblies.

3. The method of claim 1, wherein the lower speaker assembly pivots from the uppermost speaker assembly to adjust from the initial splay angle to the installation splay angle without additional manual adjustment of the suspension systems.

4. The method of claim 1, further comprising:

mounting a lowermost speaker assembly of the second set of speaker assemblies to a wheeled cart;

raising the support to lift the first line array and the second set of speaker assemblies with the wheeled cart;

locking at least one wheel of the wheeled cart;

lowering the support until the at least one locked wheel contacts an underlying surface thereby pivoting the second set of speaker assemblies about the first connection; and connecting the suspension system of the uppermost speaker assembly of the second set of speaker assemblies to the suspension system of the lowermost speaker assembly of the first line array about a second connection to form an extended line array.

5. The method of claim 4, wherein locking the at least one wheel of the wheeled cart further comprises orienting the at least one wheel transversely relative to a second wheel of the wheeled cart.

6. The method of claim 1 further comprising:

lowering the support while pivoting the second set of speaker assemblies about the first connection; and connecting the suspension system of the uppermost speaker assembly of the second set of speaker assemblies to the suspension system of the lowermost speaker assembly of the first line array about a second connection to form an extended line array.

7. The method of claim 6 further comprising:

lowering the support and the extended line array;

disconnecting an end of the suspension system of the uppermost speaker assembly of the first line array from the support;

raising the support to lift the extended line array;

releasing a locking mechanism of each suspension system in the extended line array; and lowering the support until the first line array is supported by an underlying surface, whereby each speaker assembly of the extended line array pivots from the installation splay angle to the initial splay angle.

8. The method of claim 7, wherein each speaker assembly of the extended line array pivots between the initial splay angle and the installation splay angle due to the weight of the speaker assemblies.

9. A method for assembling a line array of speaker assemblies comprising:

stacking a first speaker assembly upon a second speaker assembly;

connecting a first suspension system of the first speaker assembly to a second suspension system of the second speaker assembly at a first splay angle between the first speaker assembly and the second speaker assembly;

selecting a second splay angle between the first speaker assembly and the second speaker assembly;

connecting the first suspension system to a support;

raising the support to lift the speaker assemblies off of an underlying surface thereby adjusting the speaker assemblies from the first splay angle to the second splay angle to form a line array;

providing a second set of speaker assemblies with suspension systems;

orienting the second set of speaker assemblies below the line array;

lowering the line array;

connecting the suspension system of an uppermost speaker assembly of the second set of speaker assemblies to the suspension system of the second speaker assembly of the line array about a first connection; and raising the support to lift the line array and the second set of speaker assemblies.

10. The method of claim 9, wherein selecting the second splay angle further comprises:

inserting a pin through one of the first suspension system and the second suspension system, while the speaker assemblies are oriented at the first splay angle.

11. The method of claim 9, wherein each speaker assembly pivots from one of the first splay angle and the second splay angle, to the other of the first splay angle and the second splay angle, due to the weight of the speaker assemblies and without additional manual adjustment.

12. The method of claim 9 further comprising:

mounting a lowermost speaker assembly of the second set of speaker assemblies on a wheeled cart;

raising the support to lift the line array and the second set of speaker assemblies with the wheeled cart;

locking a first wheel of the wheeled cart;

lowering the support until the first wheel contacts an underlying surface thereby pivoting the second set of speaker assemblies about the first connection; and connecting the suspension system of the uppermost speaker assembly of the second set of speaker assemblies to the suspension system of the second speaker assembly about a second connection to form an extended line array.

13. The method of claim 12, wherein locking the first wheel of the wheeled cart further comprises turning the first wheel transversely relative to a second wheel of the wheeled cart.

14. The method of claim 9 further comprising:

lowering the support while pivoting the second set of speaker assemblies about the first connection; and connecting the suspension system of the uppermost speaker assembly of the second set of speaker assemblies to the suspension system of the second speaker assembly of the line array about a second connection to form an extended line array.

15. The method of claim 14 further comprising:

lowering the support and the extended line array;

disconnecting an end of the first suspension system from the support;

raising the support to lift the extended line array;

releasing a locking mechanism of each suspension system in the extended line array; and lowering the support until the line array is supported by an underlying surface, whereby each speaker assembly of the extended line array pivots from the second splay angle to the first splay angle.

16. A method for installation of a line array of speaker assemblies comprising:

providing at least two stacked speaker assemblies with suspension systems;

inserting a pin through the suspension system of one of the at least two stacked speaker assemblies, thereby selecting an installation splay angle between the at least two stacked speaker assemblies without additional manual adjustment of the suspension systems, while the two stacked speaker assemblies are oriented at an initial splay angle;

connecting the suspension system of an uppermost speaker assembly of the at least two stacked speaker assemblies to a support;

raising the support to lift the at least two stacked speaker assemblies, whereby the at least two stacked speaker assemblies pivot from the initial splay angle to the installation splay angle and form a line array;

lowering the support;

disconnecting a rear upper end of the suspension system of the uppermost speaker assembly of the line array;

raising the support to lift the line array;

releasing a locking mechanism of each suspension system in the line array; and lowering the support until the line array is supported by an underlying surface, whereby the at least two staked speaker assemblies of the line array pivot from the installation splay angle to the initial splay angle.

17. The method of claim 16 further comprising:

providing a second set of speaker assemblies with suspension systems;

orienting the second set of speaker assemblies below the line array;

lowering the line array;

connecting the suspension system of an uppermost speaker assembly of the second set of speaker assemblies to the suspension system of a lowermost speaker assembly of the line array about a front connection;

raising the support to lift the line array and the second set of speaker assemblies;

lowering the support while pivoting the second set of speaker assemblies rearward about the front connection; and connecting the suspension system of the uppermost speaker assembly of the second set of speaker assemblies to the suspension system of the lowermost speaker assembly of the line array about a rear connection.

* * * * *